United States Patent [19]

Daigre

[11] Patent Number: 4,944,412

[45] Date of Patent: Jul. 31, 1990

[54] ELEMENT FOR SLANTED DESK TOP RACK

[75] Inventor: Jean C. Daigre, Villemur sur Tarn, France

[73] Assignee: Societe Dacota (S.A.), Villemur sur Tarn, France

[21] Appl. No.: 243,455

[22] Filed: Sep. 12, 1988

[30] Foreign Application Priority Data

Sep. 19, 1987 [FR] France ..... 87 12664

[51] Int. Cl.[5] ..... A47F 5/00

[52] U.S. Cl. ..... 211/11; 211/50

[58] Field of Search ..... 211/11, 50, 55, 43

[56] References Cited

U.S. PATENT DOCUMENTS

| | | | |
|---|---|---|---|
| 1,379,790 | 5/1921 | Waterhouse . | |
| 1,419,485 | 6/1922 | Arcavo et al. | 211/11 |
| 2,751,088 | 6/1956 | Hargett | 211/55 |
| 2,886,182 | 5/1959 | Dauman | 211/55 |
| 2,909,287 | 10/1959 | Galassi | 211/55 |
| 3,791,651 | 2/1974 | Barnum et al. | 211/55 X |

FOREIGN PATENT DOCUMENTS 2544667 10/1984 France .

*Primary Examiner*—Robert W. Gibson, Jr.
*Attorney, Agent, or Firm*—Horst M. Kasper

[57] ABSTRACT

An element for document ordering with pigeon-holes is disclosed, where the ordering elements are inclined. The ordering element comprises a plate bent or folded for defining intersection angles (2) and walls (3) including a backing (3A), a support surface (3C) and a connection wall (3D) between the foundation base (3B) and the support surface (3C). An intersection angle (2B) and an intersection angle (2C) are formed with the latter. The ordering element comprises essentially a connection wall which is bent in the same direction as the backing (3A) in such way for forming with the said backing and the said foundation a U with unequal wings. The support surface (3C) is bent in a direction opposite to the foundation base (3B) relative to the connection wall (3D). The intersection angle (28) is provided to rest on one such surface (4). Another ordering element is placed on the said surface such that the backing (3A) is inclined versus the foundation base (3B).

9 Claims, 2 Drawing Sheets

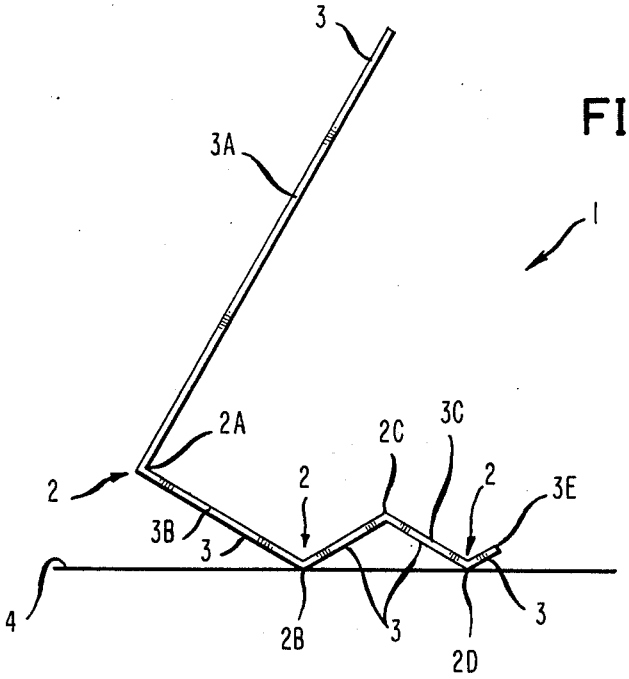
FIG. 1
FIG. 2
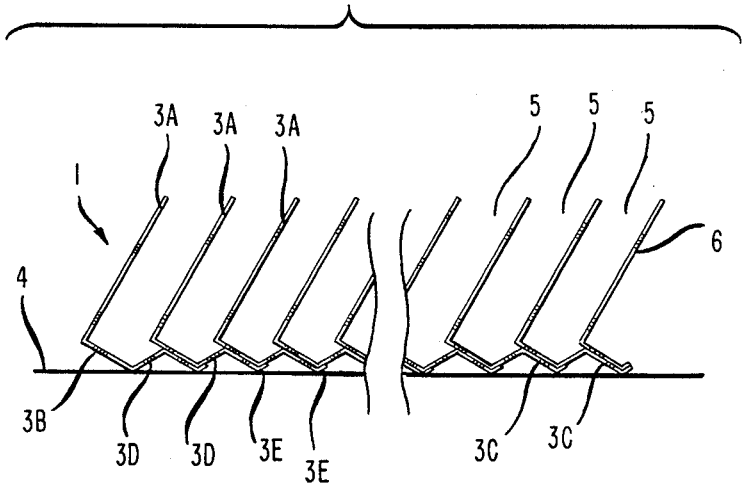

ELEMENT FOR SLANTED DESK TOP RACK

BACKGROUND OF THE INVENTION

1. Field of the Invention

The present invention relates to an ordering element for documents or other items and materials and to an ordering assembly of inclined pigeon-holes formed of several of these elements.

2. Brief Description of the Background of the Invention Including Prior Art

Ordering assemblies of canted pigeon-holes exist and for the most comprise walls for the separation of planes disposed between two horizontal shelf levels which are provided with slots or openings for the blocking and locking of said walls. These assemblies are used for their comfort and convenience and for the good maintaining of the documents which they receive. At the same time these assemblies represent inconveniences relating to their assembly and to their disassembly, which are neither quick nor easy.

The French patent No. 2,544,667 palliates and extenuates these assembly and disassembly inconveniences and proposes a modular angled pigeon-hole based on identical plates formed like a W.

These plates are positioned on a shelf and are resting one on another without requiring a locking means. At the same time the modular pigeon-holes present an inconvenience relating to the maintaining of the plates in proper position.

In fact, these plates are intended to automatically lock themselves between the weight of the documents which they suppot. However, the shape of a W of these plates does not allow a sure automatic blocking. The plates form a pigeon-hole according to that patent and are provided with a wall, which is the longest wall, against which wall the documents are supported. Said wall is inclined versus the rear relative to other walls formed on the metal plate. Thus the support of the documents on that wall tends to raise the other walls and consequently to rock or tilt against the rear of the plate.

Each plate rests on a part of another plate placed behind it and it is therefore necesary to load the compartments of this pigeon-hole formed by these plates of shape W according to a predetermined sequence in order to avoid that these said plates do not turn over.

SUMMARY OF THE INVENTION

1. Purpose of the Invention

It is an object of the present invention to provide a solution to the assembly inconveniences of prior art desk racks.

It is another object of the invention to disclose an ordering element which based on its shape ad its association with another element of identical form does automatically lock relative to this other element when it becomes loaded.

It is yet a further object of this invention to provide elements for forming a rack for a desk of a desired size without a requirement of a direct fastening attachement of the elements to each other.

These and other objects and advantages of the present invention will become evident from the description which follows.

2. Brief Description of the Invention

The present invention provides for this purpose an ordering element for ordering, organizing, and/or arranging documents and other materials which is formed of a plate which is bent along several lines which define intersection angles and wall containing the backing, an support surface furnished for receiving another ordering element and a connection wall between the foundation base and the support surface and formed respectively with these latter two intersection angles. The ordering element is essentially characterized in that the connection wall is bent in the same direction as the backing relative to the foundation base in the way of forming with said backing and the said foundation base a U shaped with unequal wings in that the support surface is bent in the opposite direction to the foundation base relative to the connection wall and is provided to rest on a surface or on another ordering element and in that the perpendicular edge of the support surface is intended to rest on said surface in such a manner that the backing the inclined above the foundation base. According to another feature of the invention or the ordering element, the support surface is disposed parallel to the foundation base.

Equally, the present invention relates to an ordering assembly of inclined pigeon-holes which is obtained from several ordering elements and which is furnished with an end ordering element which is placed on the support surface of an extreme ordering element, where the said end ordering element is provided with a backing, a foundation base and a connection wall which are inclined one relative to the other in an identical way relative to the other ordering elements of the invention.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 1 is a view of a side of an ordering element of the invention,

FIG. 2 is a side view of an ordering assembly obtained from a plurality of elements according to the invention.

DESCRIPTION OF INVENTION AND PREFERRED EMBODIMENT

In accordance with the present invention, there is provided an ordering element for documents and other materials, such as a plate 1 which is bent for defining intersection angles 2 and walls 3 which include a backing 3A, a foundation base 3B forming an intersection angle 2A with the backing 3A, a support surface 3C provided to receive another ordering element and a connection wall 3D between the foundation base 3B and the support surface 3C and with the latter forming an intersection angle 2B and an intersection angle 2C. The ordering element is defined in that the connection wall is bent in the same direction as the backing 3A relative to the foundation base 3B in the way of forming with the said backing and the said foundation base a U shape with unequal wings.

The support surface 3C is bent in a direction opposite to the foundation base 3B relative to the connection wall 3D. The intersection angle 2B between the foundation base 3B and the connection wall 3D is provided for resting on a surface 4 or on another ordering element. The edge perpendicular to the support surface 3C is provided for resting on said surface 4 in such a way that the backing 3A be inclined above the foundation base 3B.

Figure 3:
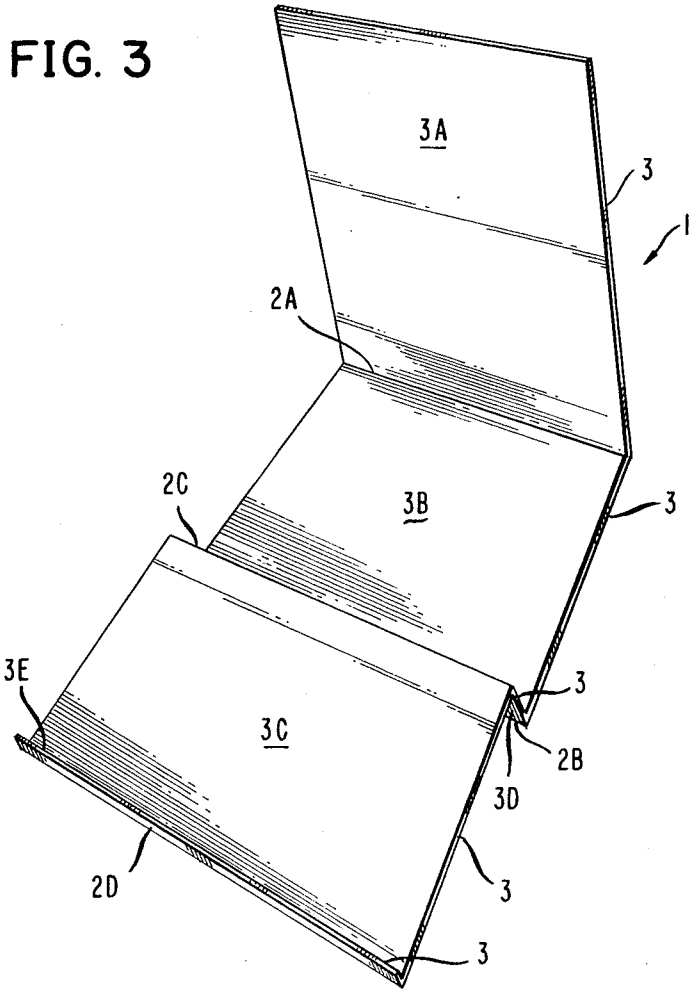
FIG. 3 is a perspective view of an ordering element.

Referring now to FIGS. 1 and 3 the ordering element for documents and other materials includes a plate 1 which is bent along several lines which define intersection angles 2 and walls 3 and which are constructed to rest on a surface 4 and/or on another element according to the invention with at least two of its intersection angles.

The wall 3 is formed by bending the plate 1 which comprises a backing 3A which is the largest length wall and which is opposite to a face on which the documents are supported, a foundation base 3B which forms an intersection angle 2A with the backing 3A and which supports the documents, a support surface 3C on which is to be disposed another invention element and a connection wall 3D between the foundation base 3B and the support surface 3C and respectively forming with the latter an intersection angle 2B and an intersection angle 2C.

Preferably, the plate 1 is rectangular and the bending lines are parallel one to another and the bending lines are perpendicular to the edges of the plate. Preferably the backing 3A is perpendicular to the foundation base 3B.

The connection wall 3D forms an intersection angle 2B with the foundation base 3B and is bent in the same direction as the backing 3A relative to the foundation base 3B in the way of forming with the said backing and the said foundation base a U of unequal wings, where the support surface 3C forms an intersection angle 2C with the connection wall 3D and is bent in a direction opposite to the foundation base 38 relative to the connection wall 3D.

The ordering element according to the invention rests on a surface 4 with the intersection angle 2B between the foundation base 3B and the connection wall 3D and by the edge perpendicular of the support surface 3C such that the backing 3A is inclined above the foundation base 3B. The angle between the foundation base 3B and the connection wall 3D is preferably larger than 90 degrees for the reasons set forth above.

The support surface 3C is bent relative to the connection wall 3D such that it is parallel to the foundation base 3B. The ordering rack assembly such as illustrated in FIG. 2 is obtained by employing several invention elements. The support surface 3C of an element is parallel to the foundation base 3B of the same element, One understands easily that the backing 3A of that ordering element is parallel to the backing 3A of the element which it supports by its support surface 3C.

Thus the ordering assembly carries several pigeon-holes 5 all inclined in an identical way and each defined by the backing 3A and the foundation base 3B of a first element and by the backing 3A of the element disposed on the support surface of said first element.

The documents placed in a pigeon-hole 5 rest on the foundation base 3B of a first element and are supported against the backing 3A of the supported element by the said first element.

Advantageously, the ordering element according to the invention is furnished with a locking means on the support surface 3C of another ordering element. This locking means is preferably provided by a heel 3E forming with the said surface support an intersection angle 2D and is obtained by bending in a direction opposite to the connection wall 3D relative to the support surface 3C.

The heel 3E is bent in such a manner that it is parallel to the connection wall 3D. The intersection angle 2D between the heel 3E and the support surface 3C is intended to rest on the surface 4.

While the heel 3E of a first ordering element according to the invention blocks from mutual shifting on the support surface 3C another ordering element placed on said support surface by supporting a part of the connection wall 3D of this other element with said heel.

Preferably, the length of the heel 3E is less than or equal to the length of the connection wall 3D. The intersection angle 2B between the foundation base and the connection wall 3D of an ordering element is placed at the level of the intersection angle 2D between the heel 3E and the support surface 3C of a first element. The intersection angle 2B of an element placed in the middle of the ordering assembly rest on another element placed behind it and the intersection angle 2D of said first element rests on the surface 4.

Only the first element of the ordering assembly rests on the surface 4 by its intersection angles 2B and 2D. The loading of a pigeon-hole 5 of the assembly according to the invention with documents results in a blockage and locking of an ordering element with respect to another.

Effectively, the documents are supported by the foundation base 3B of a first element and they are supported on the backing 3A of another element placed on top of the first. This support of documents on the backing 3A of an element placed in front favorizes a propping up and fixing of the element on the element which it supports. Moreover, the distribution of weights of the documents on the foundation base 3B of a first element favorizes equally the fixing and propping up of this element on the ordering element which it supports. No risk of rocking of one element or another exists by a loading of anyone or several pigeon-holes. The ordering elements are thus placed one after another. The elements are placed on one part of other elements and they form an ordering assembly on a surface 4 which can be formed by a set of shelves of a cabinet or otherwise.

Preferably, the ordering elements are aligned one after another in order to form an ordering assembly. The said ordering assembly is furnished at one of its extremities with an ordering element which does not define a pigeon-hole 5 between its backing 3A and its foundation base 3B with the backing 3A of another element as it is the case for all the other elements of the assembly which is provided in each case with a support surface 3C and with a heel 3D.

Figure 4:
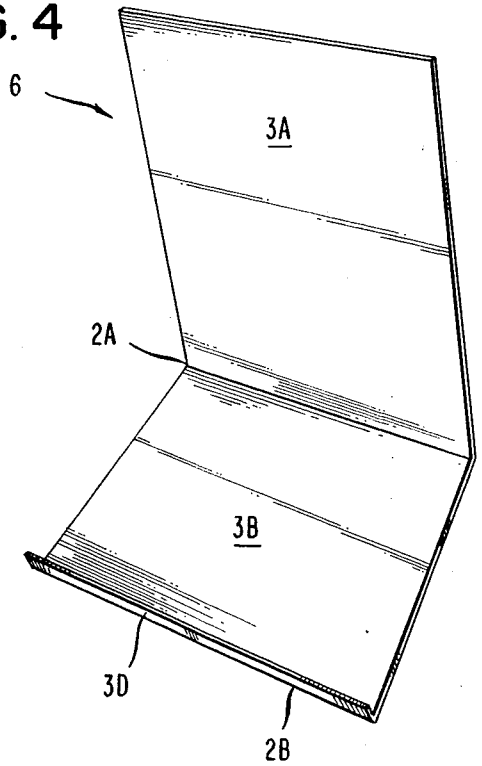
FIG. 4 is a perspective view of an end ordering element according to the invention.

In order to form another pigeon-hole 5 with the ordering element the ordering assembly is provided with an end ordering element 6. As illustrated in FIG. 4, the end ordering element is made in an identical fashion as that of an ordering element and is deprived of a support surface 3C and of a heel 3E and its connection wall 3D has a length which is substantially eaual to that of a heel 3E of an ordering element according to the invention.

Thus the end element 6 is placed on the support surface 3C of the latter ordering element by its foundation base 3B and is locked on this element by the support of its connection wall 3D against the heel 3E of the said latter element. Thus the backing 3A of this terminal end ordering element 6 forms a pigeon-hole 5 with the latter ordering element of the assembly.

In addition, this end ordering element 6 can be fixed against the latter ordering element of the assembly by any known means such as for example by screwing or other wise. The terminal end ordering element 6 allows to form a latter pigeon-hole 5 without unnecessary lengthening of the ordering assembly.

According to a further advantage of the ordering element of the invention, the angle between the foundation base 3B and the connection wall 3D is above 90 degrees in order to provide during transportation a stacking and piling up of the ordering elements one on top of the other, that is the foundation bases 3B of the elements are placed one onto another and similarly the backings 3A are disposed one against another.

The angle between the foundation base 3B and the backing 3 can be from about 85 to 120 degrees and is preferably from about 90 to 100 degrees. The angle between the foundation base 3B and the connection wall 3D can be from about 100 to 140 degrees and is preferably between 115 and 125 degrees. The angle between the connection wall 3D and the support surface 3C can be from about 100 to 140 degrees and is preferably between 115 and 125 degrees and advantageously the angles between foundation base 3B and connection wall 3D and the angles between connection wall 3D and support surface 3C are substantially equal. The angle between the heel 3E and the support surface 3C can be from about 100 to 140 degrees and is preferably between 115 and 125 degrees and advantageously the angles between foundation base 3B and connection wall 3D and the angles between heel 3E and support surface 3C are substantially eaual. The angle between support surface 3C and heel 3E can be from about 0.5 to 5 degrees larger than the angle between the foundation base 3B and the connection wall 3D.

The length of the foundation base 3B can be from 0.2 to 0.4 times the length of the backing 3A and is preferably from about 0.25 to 0.35 times the length of the backing 3A. The length of the connection wall 3D and of the support surface can be respectively from about 0.3 to 0.7 times the length of the foundation base 3B and are preferably from about 0.4 to 0.6 times the length of the foundation base. Advantageously the lengths of the connection wall and of the support surface are equal. The length of the heel 3E can be from about 0.2 to 0.7 times the length of the support surface and is preferably from about 0.3 to 0.5 times the length of the support surface.

The projection of the top edge of the backing 3A onto a plane spanned by the bending lines 2B and 2D should fall in the region between the two bending lines 2B and 2D and preferably into the center third area between the two bending lines 2B and 2D.

The ordering element according to the invention is preferably made of metal such as for example steel and aluminum, but it can also be formed of another sufficiently rigid material such as for example plastic.

The ordering element is very simply produced and it is inexpensive and it allows a quick assembly and an ordering assembly with inclined pigeon-holes can be made without special tools.

It will be understood that each of the elements described above, or two or more together, may also find a useful application in other types of box forming system configurations and document procedures differing from the types described above.

While the invention has been illustrated and described as embodimed in the context of an element for a slanted desktop rack, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An ordering element for documents and other materials comprising a plate which is bent for defining the following sections: a backing; a foundation base adjoining the backing and forming an intersection angle with the backing;

a connection wall adjoining the foundation base and forming an intersection angle with the foundation wall, wherein the connection wall is bent in the same direction as the backing relative to the foundation base in the way of forming with the said backing and the said foundation base a U with unequal wings and wherein the intersection angle between the foundation base and the connection wall is provided for resting on a board surface or on another ordering element; a support surface adjoining the connection wall and forming an intersection angle with the connection wall and provided for receiving another ordering element, wherein the support surface is bent in a direction opposite to the foundation base relative to the connection wall, wherein the support surface and the connection wall form an intersection angle, and wherein the intersection angle between the foundation base and the connection wall is provided for resting on a board surface or on another ordering element and wherein an edge perpendicular to the support surface is provided for resting on said board surface in such a way that the backing be inclined above the foundation base.

2. The ordering element according to claim 1 wherein the support surface is disposed parallel to the foundation base.

3. The ordering element according to claim 1 wherein an intersection angle between the foundation base and the connection wall is larger than 90 degrees.

4. The ordering element according to claim 1 wherein the backing and the foundation base are disposed perpendicular relative to each other.

5. The ordering element according to claim 1 wherein the support surface receives another substantially similar ordering element, and wherein a locking means becomes activated during shifting while disposed on the support surface.

6. The ordering element according to claim 5 wherein the locking means includes a heel, which forms with the support surface an intersection angle and is obtained by bending in an opposite direction to the connection wall relative to the said support surface wherein the heel and the support surface form an intersection angle, and wherein the intersection angle between the heel and the support surface provides the edge for resting on a board surface or on another ordering element.

7. The ordering element according to claim 6 wherein the heel is disposed parallel to the connection wall.

8. The ordering element according to claim 1 further comprising a second plate wherein the second plate is matingly disposed on top of the first plate.

9. The ordering element according to claim 8 further comprising an end ordering plate which includes a backing a foundation base and a connection face, which are inclined one relative to the other in an identical way relative to an ordering element.

* * * * *